United States Patent [19]

Yamada et al.

[11] 4,176,577

[45] Dec. 4, 1979

[54] ELECTRONIC MUSICAL INSTRUMENT OF WAVESHAPE MEMORY READING TYPE

[75] Inventors: Shigeru Yamada; Kiyoshi Ichikawa, both of Hamamatsu, Japan

[73] Assignee: Nippon Gakki Seizo Kabushiki Kaisha, Hamamatsu, Japan

[21] Appl. No.: 845,870

[22] Filed: Oct. 27, 1977

[30] Foreign Application Priority Data

| | | | |
|---|---|---|---|
| Oct. 30, 1976 | [JP] | Japan | 51-130733 |
| Oct. 30, 1976 | [JP] | Japan | 51-130734 |
| Oct. 30, 1976 | [JP] | Japan | 51-130735 |
| Oct. 30, 1976 | [JP] | Japan | 51-130736 |
| Oct. 30, 1976 | [JP] | Japan | 51-130737 |
| Oct. 30, 1976 | [JP] | Japan | 51-130738 |

[51] Int. Cl.[2] ..... G10H 1/02; G10H 5/00

[52] U.S. Cl. ..... 84/1.01; 84/1.19; 84/1.24; 84/1.27; 84/DIG. 2; 84/DIG. 9

[58] Field of Search ..... 84/1.01, 1.09–1.13, 84/1.19–1.21, 1.24, 1.26, 1.27, DIG. 2, DIG. 9, DIG. 20

[56] References Cited

U.S. PATENT DOCUMENTS

| | | | |
|---|---|---|---|
| 3,882,751 | 5/1975 | Tomisawa et al. | 84/1.01 |
| 4,080,862 | 3/1978 | Hiyoshi et al. | 84/1.24 |
| 4,082,027 | 4/1978 | Hiyoshi et al. | 84/1.01 |
| 4,114,497 | 9/1978 | Hiyoshi | 84/1.01 X |

*Primary Examiner*—Stanley J. Witkowski

*Attorney, Agent, or Firm*—Dike, Bronstein, Roberts, Cushman & Pfund

[57] ABSTRACT

In an electronic musical instrument comprising a keyboard including a plurality of keys, a frequency information memory device for storing frequency informations corresponding to respective keys, a plurality of musical tone forming means including a waveshape memory device for forming musical tones in response to the output of the frequency information memory device, and a shift circuit interposed between the frequency information memory device and the musical tone forming means for effecting a footage change of an octave unit, there is provided a preset circuit for applying a plurality of preset footage signals to the shift circuit and for applying another preset signals which are necessary to form musical tones to the musical tone forming means.

9 Claims, 10 Drawing Figures qF FROM ACCUMULATOR 4
qF1
qF2
qF3
qF4
qF5
qF6
qF7
qF8
qF9
qF10
5
50a
50b
50c
50d
60
51a
51b
51c
51d
61
52a
52b
52c
52d
62
53a
53b
53c
53d
63
54a
54b
54c
54d
64
55a
55b
55c
55d
65
56a
56b
56c
56d
66
57a
57b
57c
67
58a
58b
68
59
qF'1
qF'2
qF'3
qF'4
qF'5
qF'6
qF'7
qF'8
qF'9
qF'10
TO WAVESHAPE MEMORY 6a–6c
16' 8' 4' 2'
TP FROM FIG.3

ELECTRONIC MUSICAL INSTRUMENT OF WAVESHAPE MEMORY READING TYPE

BACKGROUND OF THE INVENTION

This invention relates to an electronic musical instrument and more particularly to an electronic musical instrument in which frequency informations corresponding to tone pitch of respective keys of a keyboard are stored in a frequency information memory device and musical tones corresponding to depressed keys are formed by reading out waveshape memories using the informations from the frequency information memory device.

In the electronic musical instrument of the type described above, since the musical tones are generated through digital processing, for example by reading out frequency information corresponding to tone pitch of respective keys from the frequency information memory, and by reading out waveshape information necessary for generating musical tones from the waveshape memory using the frequency information, it is possible to generate many tone colors (waveshape) and various musical effects and such musical instrument is characterized by enriching the represention of music.

In such a musical instrument, it has been proposed a footage change in which the pitches of the generated musical tones are shifted by an octave unit. The purpose of the footage change is to improve the effect of a concert and to obtain most suitable footage for the music played when the electronic musical instrument is played in a concert with other musical instruments. In order to enable to simply and readily change the register footage at the time of commencing a performance or during the performance, it is desirable to preset a footage signal.

Among musical instruments with footage change may be mentioned a copending U.S. patent application Ser. No. 678,709 filed on Apr. 20, 1976 by Teruo Hiyoshi et al and now U.S. Pat. 4,082,027 of the title "Electronic Musical Instrument." In the electronic musical instrument disclosed in this patent application, when a footage change is desired, the player manually operates a footage change knob to perform a desired footage change. To perform a footage change it is necessary to adjust the volume and color of the tone so that the player is required to manually operate the knobs for adjusting the volume and color concurrently with the adjustment of the footage change knob.

However it is troublesome and time consuming to operate various knobs.

SUMMARY OF THE INVENTION

Accordingly, it is the principal object of this invention to provide a novel electronic musical instrument capable of simultaneously presetting various parameters including a footage change for effecting a register footage change by an octave unit prior to or during performance by a single manual operation.

Another object of this invention is to provide an electronic musical instrument capable of shifting the generated musical tone to a footage register appropriate for its tone color when the tone color of a flute, clarinet or the like is switched in connection with the footage change.

Still another object of this invention is to provide a novel electronic musical instrument capable of preventing change in the tone color when the tone color is switched as above described.

Yet another object of this invention is to provide a novel electronic musical instrument capable of preventing change in the tone volume when the tone color is switched as above described.

A further object of this invention is to provide an electronic musical instrument capable of presetting the volume of the musical tone as the tone color is switched as above described.

Still a further object of this invention is to provide an electronic musical instrument capable of presetting the brightness voltage when the tone color is switched.

According to one embodiment of this invention there is provided an electronic musical instrument comprising a keyboard including a plurality of keys, a frequency information memory device which stores frequency informations corresponding to respective keys of the keyboard, a plurality of musical tone forming means including a waveshape memory device for forming musical tones in response to the output of the frequency information memory device, a shift circuit interposed between the frequency information memory device and the musical tone forming means for effecting a footage change by an octave unit, a preset circuit for applying a plurality of preset footage signals to the shift circuit and for applying other preset signals necessary to form the musical tones to the musical tone forming means, and a manually operable preset selector for simultaneously determining the preset signals.

According to another embodiment of this invention, there is provided an electronic musical instrument comprising a keyboard including a plurality of keys, a frequency information memory device storing frequency informations corresponding to respective keys, waveshape memory means responsive to the output of the frequency information memory device for producing informations necessary to form musical tones, a musical tone forming circuit responsive to the output of the waveshape memory device for forming a desired musical tone, a shift circuit interposed between the frequency information memory device and the waveshape memory device for effecting a footage change by an octave unit, a plurality of manually operable preset selectors, preset means operated by the preset selectors for presetting a plurality of preset values for determining different informations, and means for applying one of the preset values of the preset selectors simultaneously selected in accordance with a selected preselector to the shift circuit.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
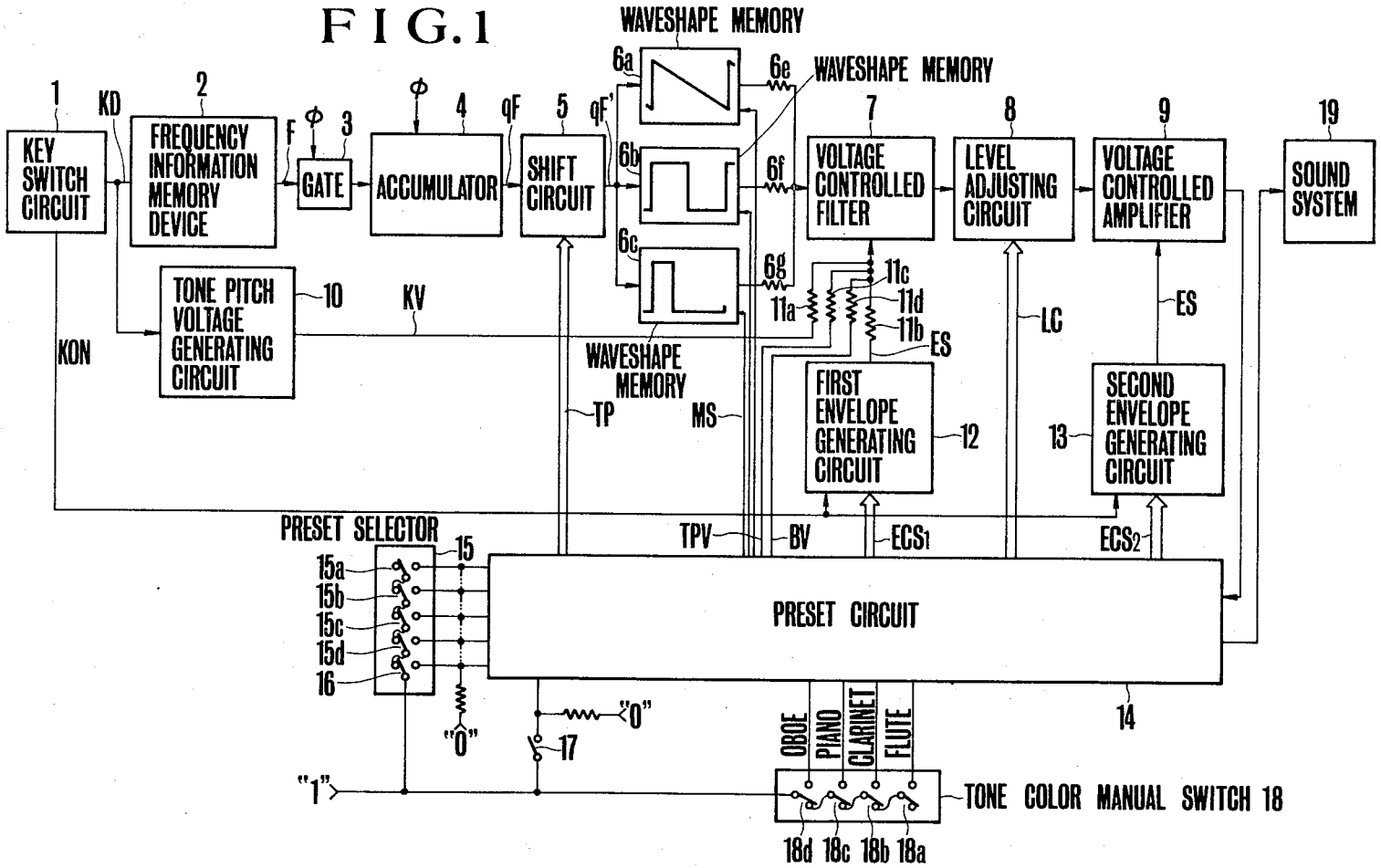
FIG. 1 is a block diagram showing one embodiment of the electronic musical instrument embodying the invention.

FIG. 1 of the accompanying drawing is a block diagram showing one embodiment of the electronic musical instrument of this invention especially of the monotone generating construction. A keyboard is provided with a key switch circuit 1 which produces key data KD corresponding to depressed keys. As shown in the following Table 1 the key data KD specific to respective keys each comprises a total of 9 bit code including a two-bit code $K_2$ and $K_1$ representing the keyboard, a three-bit code $B_3$, $B_2$ and $B_1$ representing the octaverange and a four-bit code $N_4$, $N_3$, $N_2$ and $N_1$ representing the note name in an octave. For Example, the key data KD representing the note F in the third octave on the pedal keyboard is "110100101".

Table 1

| key | | Key Data KD | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| | upper | 0 | 1 | | | | | | | |
| keyboard | lower | 1 | 0 | | | | | | | |
| | pedal | 1 | 1 | | | | | | | |
| | first | | 0 | 0 | 0 | | | | | |
| octave | second | | | 0 | 0 | 1 | | | | |
| | third | | | 0 | 1 | 0 | | | | |
| range | fourth | | | 0 | 1 | 1 | | | | |
| | fifth | | | 1 | 0 | 0 | | | | |
| | sixth | | | 1 | 0 | 1 | | | | |
| | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| note name | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

In FIG. 1 reference charactor 2 designates a frequency information memory device which receives the key data KD from the key switch circuit 1 which corresponds to the depressed keys and act as address signals to read hereinafter mentioned waveshape memories. The frequency information memory device 2 produces data F as frequency informations as shown in Table 2 corresponding to the input key data KD.

In the case shown in Table 2, the binary data F stored in the frequency information memory device 2 comprise 15 bits, of which one bit represents an integer part and the other 14 bits a fraction part of the frequency information. In Table 2, F values in the rightmost column represent decimal values corresponding to the binary values. In this table, only eight examples are shown, as the data F are proportional to the frequencies of the notes.

Table 2

| | interger part | fraction part | | | | | | | | | | | | | | |
|---|---|---|---|---|---|---|---|---|---|---|---|---|---|---|---|---|
| note | 15 | 14, | 13, | 12, | 11, | 10, | 9, | 8, | 7, | 6, | 5, | 4, | 3, | 2, | 1, | F value |
| $C_2$ | 0 | 0 | 0 | 0 | 0 | 1 | 1 | 0 | 1 | 0 | 1 | 1 | 0 | 0 | 1 | 0.052325 |
| $C_3$ | 0 | 0 | 0 | 0 | 1 | 1 | 0 | 1 | 0 | 1 | 1 | 0 | 0 | 1 | 0 | 0.104650 |
| $C_4$ | 0 | 0 | 0 | 1 | 1 | 0 | 1 | 0 | 1 | 1 | 0 | 0 | 1 | 0 | 1 | 0.209300 |
| $C_5$ | 0 | 0 | 1 | 1 | 0 | 1 | 0 | 1 | 1 | 0 | 0 | 1 | 0 | 1 | 0 | 0.418600 |
| $C_6$ | 0 | 1 | 1 | 0 | 1 | 0 | 1 | 1 | 0 | 0 | 1 | 0 | 1 | 0 | 0 | 0.837200 |
| $D_6$# | 0 | 1 | 1 | 1 | 1 | 1 | 1 | 1 | 0 | 1 | 1 | 1 | 0 | 0 | 0 | 0.995600 |
| $E_6$ | 1 | 0 | 0 | 0 | 0 | 1 | 1 | 1 | 0 | 0 | 0 | 0 | 0 | 0 | 1 | 1.054808 |
| $C_7$ | 1 | 1 | 0 | 1 | 0 | 1 | 0 | 0 | 0 | 1 | 0 | 1 | 0 | 0 | 1 | 1.674400 |

Reference numeral 3 designates a gate circuit controlled by a clock pulse $\phi$, and 4 an accumulator which accumulates, at timing of the clock pulse $\phi$, the output signal of the frequency information memory device, that is the data F which is supplied thereto through the gate circuit 3 and delivers progressing values qF (where q=1, 2, 3, . . . ),and 5 a shift circuit which shifts the bits of the accumulated data qF (a digital data) accumulated by the accumulator 4 upwardly or downwardly (effecting octave shift) in accordance with a footage signal from a preset circuit 14 to be described later, 6*a* through 6*c* represent first to third waveshape memory devices addressed by the output from the shift circuit 5 which are respectively storing amplitude data (values) of respective sampling points of a triangular wave, a symmetrical rectangular wave and an asymmetrical rectangular wave, for example, each of which is devided into 64, for example, along the time axis.

Accordingly, the first to third waveshape memory devices 6*a* through 6*c* are sequentially addressed by the progressing output qF of the accumulator 4 which is supplied through shift circuit 5, thus reading out the waveshapes stored therein. Reference numeral 7 represents a voltage controlled filter (VCF) supplied with the outputs of the first to third waveshape memory devices 6*a* through 6*c*, 8 a level adjusting circuit in which the level of the musical tone supplied through the voltage control filter is controlled by a tone volume level set signal LC supplied from a preset circuit 14 to be described later, 9 a voltage controlled amplifier (VCA) for performing an envelope control for the musical tone output from the level adjusting circuit 8, and 10 a tone pitch voltage generating circuit which generates a tone pitch voltage KV corresponding to a key data KD supplied from the key switch circuit 1, and supplies the generated tone pitch voltage KV to the voltage controlled filter 7 via a resistor 11*a* to act as a control signal. There are provided a first envelope generating circuit 12 which supplies an envelope signal (usually called this way, but only a control voltage shape signal) ES to the voltage controlled filter 7 via resistor 11*b*, a second envelope generating circuit 13 which applies another envelope signal ES to the voltage controlled amplifier 9, and a preset circuit 14 including a plurality of tone color channels (in this example 4) for generating control signals for setting a plurality of musical tone states (qualities). As will be described later in detail, the preset circuit 14 is constructed to preset a footage determining signal TP, a waveshape memory selection signal MS, for the first to third waveshape memory devices 6a to 6c, envelope preset signals $ECS_1$ and $ECS_2$ for the first and second envelope generating circuits 12 and 13, a tone level control signal LC, a transposition voltage TPV and a brightness voltage BV. A preset selector 15 is provided including selection switches 15a through 15d which are provided for respective channels and are used to select preferentially connected preset channels, thereby selecting a control signal for a given channel among various control signals suitably set for respective channels by the player. The preset selector 15 further comprises a cancel switch 16 to be preferentially connected to selection switches 15a through 15d. These switches 15a–15d and 16 are mounted on suitable positions (for example on the operating panel) that can be readily accessed by the player during performance. A non-lock type cancel switch 17 is located at a position to be readily operable by a foot (for example, the key of the righthand foot). The cancel switch 17 is connected in parallel with the cancel switch 16 for attaining the same object. A tone color manual switch 18 which is preferentially connected and a plurality of tone color selecting switches 18a through 18d for deriving out fixed (not variable) control signals corresponding to respective tone colors from the preset circuit 14 which stores various control signals under standard state which are necessary to form musical tone of a flute, clarinet, piano, oboe etc. Thus by operating the tone color selecting switches 18a through 18d it is possible to produce musical tones having standard colors. Reference numeral 19 represents a sound system with its input connected to receive the output of the voltage control amplifier 9 via the volume preset member of the preset circuit 14 to be described later. The sound system 19 is constituted by an expression control circuit, an amplifier, a loudspeaker etc.

With the circuit shown in FIG. 1, when a key of the keyboard is depressed, the key switch circuit 1 produces a key data signal KD identifying the depressed key. The key switch circuit 1 also supplies a key-on signal KON to the first and second envelope generating circuits 12 and 13. The key data signal KD generated by the key switch circuit 1 is supplied to the frequency information memory device 2 to read out the frequency information, that is a datum F stored in an address designated by the key data KD. The value F is applied to the accumulator 4 via gate circuit 3 so that the accumulator 4 cumulatively adds the value F at the timing speed $\phi$ of the gate circuit 3 to supply the progressing accumulated value qF ($q=1, 2, 3, \ldots$) to the first to third waveshape memory devices 6a to 6c via shift circuit 5 to act as an address signal. When the accumulated value qF reaches the last address (for example 64) of the first to third waveshape memory devices 6a to 6c the accumulator 4 overflows and comes back to zero. The operation described above is repeated to designate addresses. In this manner, the period of the read out waveshape is determined by the progressing speed of the output qF of the accumulator 4.

Thus, one or more of the sequentially addressed waveshape memory devices are selected by the waveshape memory selection signal MS supplied from the preset circuit 14 for producing a desired tone color, and the outputs of the selected waveshape memory devices are supplied to a voltage controlled filter 7 via mixing resistors 6c, 6f and 6g. The cut off frequency of the voltage controlled filter 7 is controlled by an envelope control signal ES which varies with time and supplied from the first envelope generating circuit 12 which is started by the key-on signal KON supplied from the key switch circuit 1, thus effecting a tone color modulation.

The cut off frequency of the voltage controlled filter 7 is also controlled by a tone pitch voltage KV supplied from the tone pitch voltage generating circuit 10 via resistor 11a and corresponding to the tone pitch of the operated key. This maintains the ratio of the higher harmonic components to the fundamental wave at a definite value for each pitch thereby averaging the tone color at each tone pitch. The musical tone signal which has been subjected to a tone color modulation as above described is applied to the voltage controlled amplifier 9 via the level adjusting circuit 8 in which the amplitude envelope is controlled by the envelope signal ES supplied by the second envelope generating circuit 13 which is started by the key-on signal KON. The envelope controlled tone signal is then supplied to the sound system 19 via the volume presetting circuit for producing a musical tone.

In the normal state (preset cancel) a tone color selected by tone color selecting switches 18a and 18d is produced. In other words, the preset circuit 14 is constructed such that the standard tone colors of flute, clarinet, piano and oboe are selected by the tone color selecting switches 18a through 18d. For example, when the tone color selecting switch 18a is closed a waveshape memory selection signal MS, an envelope control signal ECS and a level control signal LC which are required to form standard tone colors of the flute stored in the preset circuit 14. Consequently, by the selective operation of tone color selecting switches 18a through 18d, it is possible to produce musical tones having four prescribed colors. As will be described hereinafter, the preset circuit 14 is provided with a preset system including a plurality of tone color channels (in this example 4) in which a footage signal TP which is used to shift octave range, a waveshape memory selection signal MS, a transposition voltage TPV, a brightness voltage BV, an envelope control signal ECS and a level control signal LC may be suitably preset by the player. Consequently, by operating either one of the preset channel selection switches 15a through 15d which have been connected preferentially, a preset channel corresponding to the operated switch is selected to produce various control signals TP, MS, TPV, BC, $ECS_1$, $ECS_2$ and LC preset in the selected preset channel corresponding to the operated switch for producing a desired musical tone. When the preset cancel switch 16 is operated, since this switch is preferentially connected to the preset channel selection switches 15a through 15d, the selection of the preset channels is released. As a result of the operation of the preset cancel switch 16 the manual tone color selecting system is rendered operative thereby producing tone colors selected by the closed tone color selecting switches 18a through 18d. Furthermore, as the non-lock type cancel switch 17 is operated by the knee of the player during performance, a signal "1" is supplied to the preset circuit 14 via the switch 17 while it is closed whereby the same state as that caused by the operation of the preset cancel switch 16 will be produced. Accordingly, even when the player in busy for manipulating the keyboard so that it is difficult to operate the switch 16, the switch 17 can be operated by his leg.

Having completed the description of the outline of the preset circuit 14, the detail thereof will now be described with reference to FIG. 2.

Waveshape Memory Selection Signal MS Level Adjusting Signal LC

The waveshape memory selection signal MS is used to select either one (or two or more) of the first to third waveshape memory devices 6a to 6c and comprises a three bit digital signal.

The level adjusting signal LC is used to set the volume level of the musical tone signal from the voltage controlled filter 7 corresponding to the tone color thereby compensating for the level change caused by the tone color. This signal comprises a four bit digital signal and sets and controls the level of the musical tone in four steps.

Figure 2:
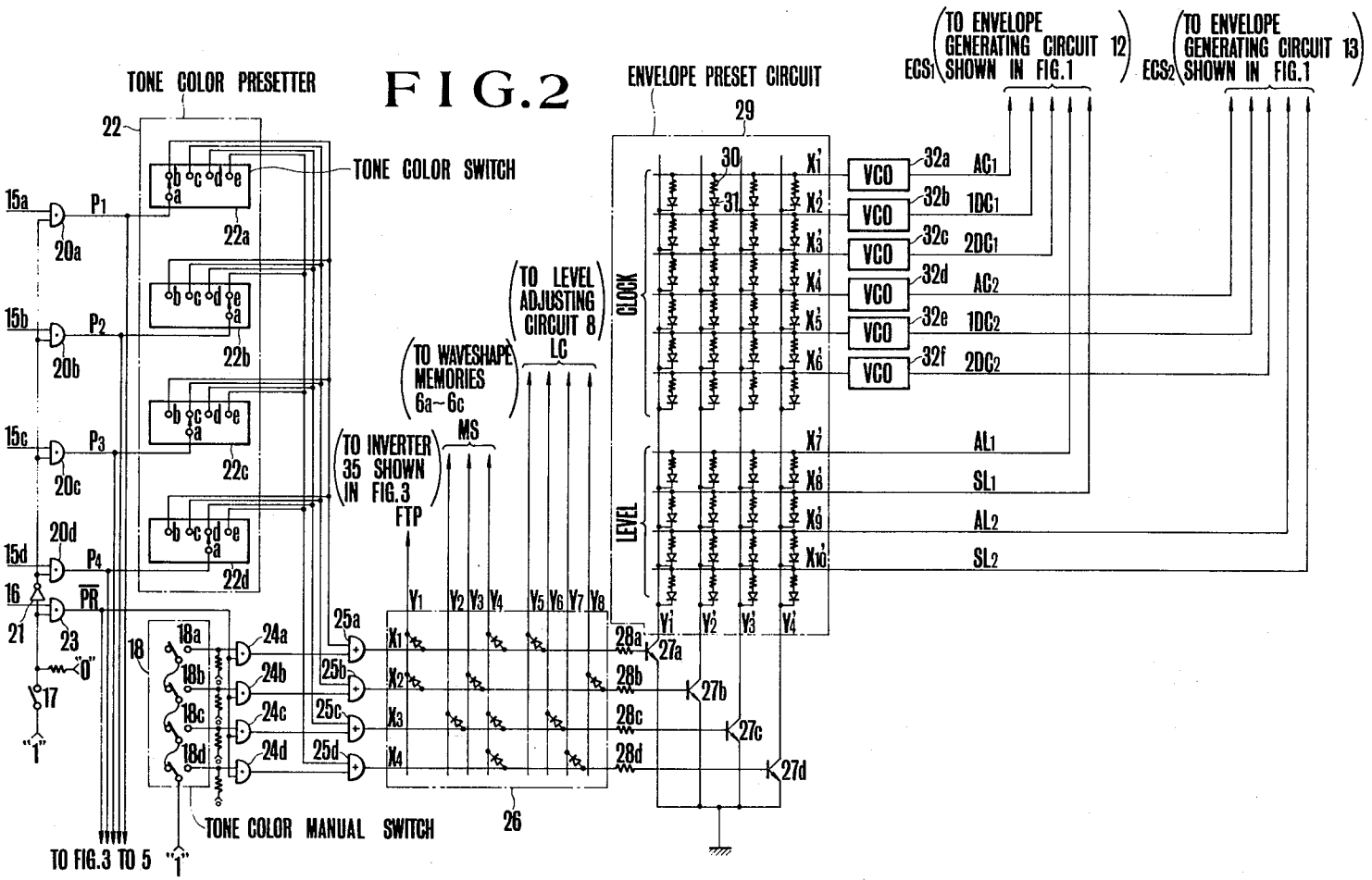
FIGS. 2 to 5 are detailed connection diagrams showing the preset circuit shown in FIG. 1.

These waveshape memory selection signal MS and the level adjusting signal LC are generated by a diode matrix network 26 shown in FIG. 2. AND gate circuits 20a through 20d are enabled when the set output signals of preset channel selection switches 15a through 15d and the output of the preset cancel switch 17 (which is applied through an inverter 21) are applied to their inputs to produce channel selection signals $P_1$ through $P_4$ which are respectively applied to common terminals a of respective tone color preset switches 22a through 22d of the tone color presetter 22. Corresponding stationary contacts b through e of the tone color preset switches 22a through 22d are commonly connected together respectively. The stationary contacts b through e correspond to respective tone color designations allocated to tone color selection switches 18a through 18d. Thus, terminal b is assigned for a flute, terminal c for a clarinet, terminal d for a piano and terminal e for an oboe. The outputs of the preset cancel switches 16 and 17 are applied to the inputs of an AND gate circuit 23 to produce a preset cancel signal $\overline{PR}$. This preset cancel signal $\overline{PR}$ and respective outputs of the tone color selecting switches 18a through 18d are applied to the inputs of AND gate circuits 24a through 24d so as to derive out the outputs of the tone color selecting switches when both preset cancel switches 16 and 17 are not operated. The inputs of OR gate circuits 25a through 25d are connected to receive the outputs of the commonly connected stationary contacts of the tone color preset switches 22a through 22d and the outputs of AND gate circuit 24a through 24d respectively and their outputs are applied to the X lines $X_1$ through $X_4$ of the diode matrix network 26 adapted to set a fixed footage designation signal FTP, the waveshape memory selection signal MS, and the level control signal LC, these control signals being derived out through the Y lines $Y_1$ through $Y_8$. The setting of the signals FTP, MS and LC are performed by diodes connected at the cross-points between the X and Y lines of the diode matrix network 26. The outputs of Y lines $Y_2$, $Y_3$ and $Y_4$ constitute the waveshape memory selection signal MS while the outputs of Y lines $Y_5$ through $Y_8$ constitute the level adjusting signal LC.

When the preset tone color selection switch 15a, for example, is operated this switch produces a signal "1" which is applied to the inputs of AND gate circuit 20a together with the output produced by the preset cancel switch 17 and inverted by the inverter 21, thus producing the tone color selection signal $P_1$ which is applied to the tone color preset switch 22a. Assuming now that the contact a is thrown to the stationary contact b at this time, the tone color selection signal $P_1$ selects the X line $x_1$ through the tone color selection switch 22a and the OR gate circuit 25a, thus producing outputs on only Y lines $Y_1$, $Y_4$ and $Y_5$. When the output appears on Y line $Y_4$, the waveshape memory selection signal MS becomes "001" whereby only the first waveshape memory device 6a is selected to supply the waveshape stored therein to the voltage controlled filter 7 for producing a musical tone waveform corresponding to the tone color of a flute. When an output is produced only on the Y line $Y_5$, the level control signal LC becomes "1000" with the result that the level adjusting circuit 8 controls the level of the musical tone signal supplied from the voltage controlled filter 7 to have value corresponding to the preset value "1000" described above and supplies the musical tone signal to the voltage controlled amplifier 8. The object of the control described above is to prevent any variation in the volume caused by the change of the tone color and to control the volume appropriate for the particular color.

Envelope Control Signals $ECS_1$, $ECS_2$

Figure 9:
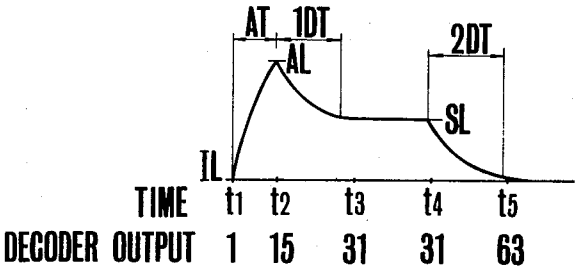
FIG. 9 is a graph showing one example of an envelope signal produced by the circuit shown in FIG. 6.

The envelope control signals $ECS_1$ and $ECS_2$ are generated by an envelope preset circuit 29 in FIG. 2, and adopted to set the attack time AT, first and second decay times 1DT and 2DT, the attack level AL and the sustain level SL of the envelope signal ES generated by the first and second envelope generating circuits 12 and 13 respectively, as shown in FIG. 9.

As shown in FIG. 2, NPN type transistors 27a through 27d are turned ON by the outputs of OR gate circuits 25a through 25d respectively supplied through resistors 28a through 28d for selecting Y lines $Y_1'$ through $Y_4'$ of the envelope preset circuit 29. The envelope preset circuit 29 further comprises X lines $X_1'$ through $X_{10}'$ intersecting respective Y lines $Y_1'$ through $Y_4'$ resistors 30 and diodes 31 provided at the cross-points between the X and Y lines. By presetting the values of resistors 30 respective X lines produce four types of the preset voltages for each Y line. The X lines $X_1'$ through $X_6'$ of the envelope preset circuit 29 are used to generate the time information, whereas X lines $X_7'$ through $X_{10}'$ are used to produce the level information. The outputs of X lines $X_1'$ through $X_6'$ for producing the time information are applied to voltage controlled oscillators 32a through 32f for controlling the oscillation frequencies thereof. The output signals (frequency signals) $AC_1$, $1DC_1$ and $2DC_1$ of these voltage controlled oscillators 32a through 32c and the output signals (voltage signals) $AL_1$ and $SL_1$ of the X lines $X_7'$ and $X_8'$ are supplied to the first envelope generating circuit 12 to act as the envelope control signal $ECS_1$. In the same manner, the output signals (frequency signals) $AC_2$, $1DC_2$ and $2DC_2$ of the voltage controlled oscillators 32d through 32f and the output signals (voltage signals) $AL_2$ and $SL_2$ of the X lines $X_9'$ and $X_{10}'$ are applied to the second envelope generating circuit 13 to act as the envelope control signal $ECS_2$.

In the preset system of the envelope control signal described above, when the preset tone color selection switch 15a is closed, the OR gate circuit 25a produces an output signal through tone color preset switch 22a thereby turning ON only transistor 27a. Accordingly, only the Y line $Y_1'$ of the envelope preset circuit 29 is selected. As a consequence, respective X lines $X_1'$ through $X_{10}'$ produce preset voltage signals having values corresponding to the values of resistors 30 provided for respective cross points of the Y line $Y_1$ and X lines $X_1'$ through $X_{10}'$. The outputs of X lines $X_1'$ through $X_2'$ are applied to voltage controlled oscillators 32*a* through 32*c* respectively for producing oscillation outputs having frequencies responsive to the voltage signals.

The output signals of these voltage controlled oscillators 32*a* through 32*c* are applied to the first envelope generating circuit 12 to act as an attack clock for determining the attack time AT, and signals $1DC_1$ and $2DC_1$ for determining the first and second decay times 1DT and 2DT respectively.

The output signals $AL_1$ and $SL_1$ (voltage signals) of the X lines $X_7'$ and $X_8'$ are supplied without any change, to the first envelope generating circuit 12 for determining the attack level AL and the sustain level SL. Consequently, the envelope waveform of the signal generated by the first envelope generating circuit 12 is controlled by the envelope control signal $ECS_1$ formed by signals $AC_1$, $1DC_1$, $2DC_1$ and $SL_1$. The ouptut signals $AC_2$, $1DC_2$ $2DC_2$ of the preset voltage controlled oscillators 32*d* through 32*f* and the output signals $AL_2$ and $SL_2$ of X lines $X_9'$ and $X_{10}'$ are supplied to the second envelope generating circuit 13 to act as the envelope control signal $ECS_2$. Consequently, the duration and level of the attack and the first decay portion of the signals generated by the first and second envelope generating circuits 12 and 13 are controlled corresponding to the build up portion of the key on signal KON supplied by the key switch circuit 1, while the duration and level of the second decay portion are controlled by the build down portion of the key on signal KON caused by key release to correspond to the preset value.

Footage Signal TP, Transposition Voltage TPV, Fixed Footage Designation Signal FTP The footage signal TP is a 4 bit digital signal and is used to set and control in octave units the footage of a musical tone to be generated by shifting the accumulated values from the accumulator 4 and controls the shifting operation in the shift circuit 5. The purpose of the transposition voltage TPV is to prevent the variation in the tone color when the tone range is varied by the footage signal TP. A voltage signal which is preset corresponding to the footage signal TP is applied to the voltage controlled filter 7 through resistor 11*c* (FIG. 1) for controlling the frequency characteristic of the filter.

Figure 3:
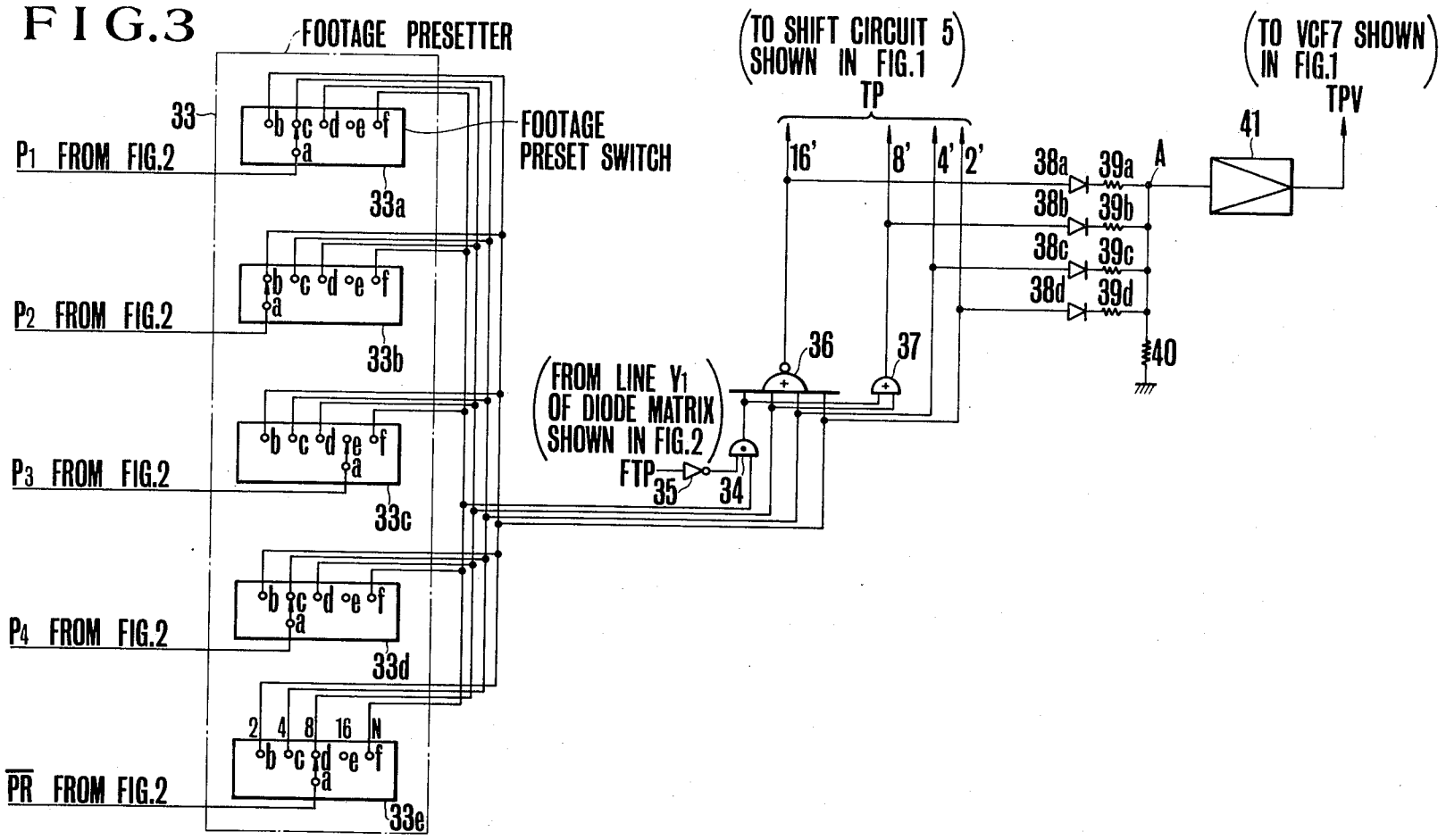

FIG. 3 is a connection diagram showing one example of the footage change system in the preset circuit 14 in which terminals a of respective footage preset switches 33*a* through 33*e* of the footage presetter 33 which are provided for respective preset tone color channels are supplied with the preset tone color selection signals $P_1$ through $P_4$ and the preset cancel signal $\overline{PR}$ described in connection with FIG. 2. The stationary contacts b through f of the footage preset switches 33*a* through 33*e* determine the direction and amount of shift. Thus, contact b is used to shift the signal by 2 bits towards the most significant digit for producing 2 foot register tones, contact c to shift the signal by 1 bit towards the most significant digit (for 4 foot), terminal d not to shift (for 8 foot), terminal e to shift 1 bit towards the least significant bit (for 16 foot), while terminal f is connected to receive the fixed footage designation signal FTP generated by the diode matrix network 26 shown in FIG. 2. The fixed footage designation signal FTP is a footage signal having a fixed reference value and utilized to set the musical tone having a color selected by the tone color selecting switches 18*a* through 18*d* to a footage which is most suitable for that color. Corresponding ones of the stationary contacts of the footage preset switches 33*a* through 33*e* are commonly connected together. Stationary contacts e are idle and signals are produced on the assumption that where all outputs of the other stationary contacts b, c, d and f are "0" the stationary contact e will be selected. With this method, it is possible to save one wiring conductor thereby increasing the freedom in the design of integrated circuits. The outputs of the commonly connected stationary contacts f of respective footage preset switches 33*a* through 33*e* and the fixed footage designation signal FTP supplied from the diode matrix network 26 through an inverter 35 are applied to the inputs of an AND circuit 34, and the outputs of commonly connected stationary contacts b, c, d and f of the footage preset switches 33*a* through 33*e* are applied to the inputs of a NOR gate circuit 36. The output of the AND gate circuit 34 and the outputs of the commonly connected stationary contacts d are applied to an OR gate circuit 37. The outputs of the NOR gate circuit 36, OR gate circuit 37 and the outputs of the commonly connected stationary contacts b and c of the footage preset switches 33*a* through 33*e* are applied to the shift circuit 5 shown in FIG. 1 to act as the footage signal TP. The four bits of the footage signal TP are respectively applied to a shunt resistor 40 through diodes 38*a* through 38*d* and resistors 39*a* through 39*d* for respective voltage divisions and addition. The output terminal A of the resistor 40 is connected to a buffer amplifier 41 and the output thereof is supplied to the voltage controlled filter 7 to act as the transposition voltage TPV. The values of respective resistors 39*a* through 39*d* are set to obtain voltages corresponding to the footage change effected in the shift circuit 5.

In the footage change preset system having a construction described above, when the preset tone color selection switch 15*a* is operated to produce a preset channel signal $P_1$ as above described, since the stationary contact c of the footage select switch 33*a* in charge of the preset channel signal $P_1$ is selected, an output is produced on a 4 foot register line thus changing the footage signal TP to "0010". In the illustrated example, the signal "0010" meaning 4-foot sets the shift circuit 5 to change the footage one octave higher, as the signal "0100" meaning 8-foot is the normal footage register. Consequently, when the movable contacts a of the footage preset switches 33*a* through 33*e* are connected to the stationary contacts b the footage is changed higher by 2 octaves (2-foots), whereas when the stationary contacts d are selected the footage is shifted to the normal pitch. When the stationary contacts e are selected the footage is changed lower by one octave (16-foot). Furthermore, when the stationary contacts f are selected the footage is changed corresponding to the fixed footage designation signal FTP described above whereby a footage change appropriate for the tone color is set. When the footage change is effected in this manner, a voltage signal preset in resistors 39*a* through 39*d* corresponding to the footage signal TP is produced at the output terminal A. This voltage signal is applied to the voltage controlled filter 7 via the buffer amplifier 41 to act as the transposition voltage whereby the cut-off frequency of the filter 7 is controlled in accordance with the amount of footage change caused by the footage signal TP, thus preventing the change in the tone color caused by the footage change.

While the preset cansel switch 16 or 17 is being operated, a preset cancel signal $\overline{PR}$ is generated and applied to the footage preset switch 33*e* so that the footage change of the tone caused by the operation of the tone color selecting switches 18*a* through 18*d* will be determined by the footage preset switch 33*e*. The footage preset switch 33*e* is used to purposely change the fixed footage designation signal FTP when the tone color selected by the tone color selecting switch 18*a* is used to concert with other musical instruments.

Tone Brightness Voltage BV

Figure 4:
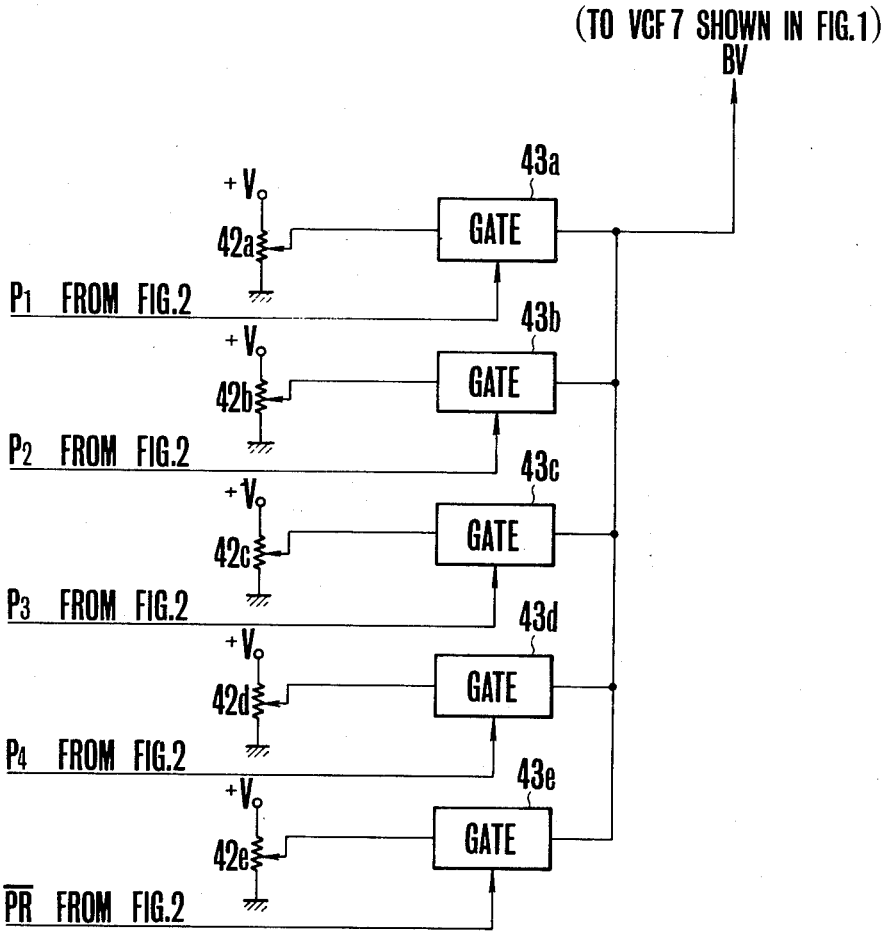

The tone brightness voltage BV is used to control the ratio of the higher harmonic components to the fundamental wave by delicately varying the frequency characteristic of the voltage controlled filter 7 thereby controlling the brightness of the musical tone by the ratio of the higher harmonic components contained therein. The tone brightness voltage BV is generated by a circuit shown in FIG. 4 which comprises variable resistors 42*a* through 42*e* adapted to preset the tone brightness voltage BV in respective preset tone color channels and the preset cancel channel. The output signals of variable resistors 42*a* through 42*e* are applied to the voltage controlled variable filter 7 via gate circuits 43*a* through 43*e* which are controlled by the preset channel selection signals $P_1$ through $P_4$ and the preset cancel signal $\overline{PR}$. Consequently, when the preset channel selection signal $P_1$, for example, is generated, only gate circuit 43*a* is enabled to supply the tone brightness signal BV that has been preset in the variable resistor 42*a* to the voltage controlled variable filter.

Tone Volume Preset Signal

Figure 5:
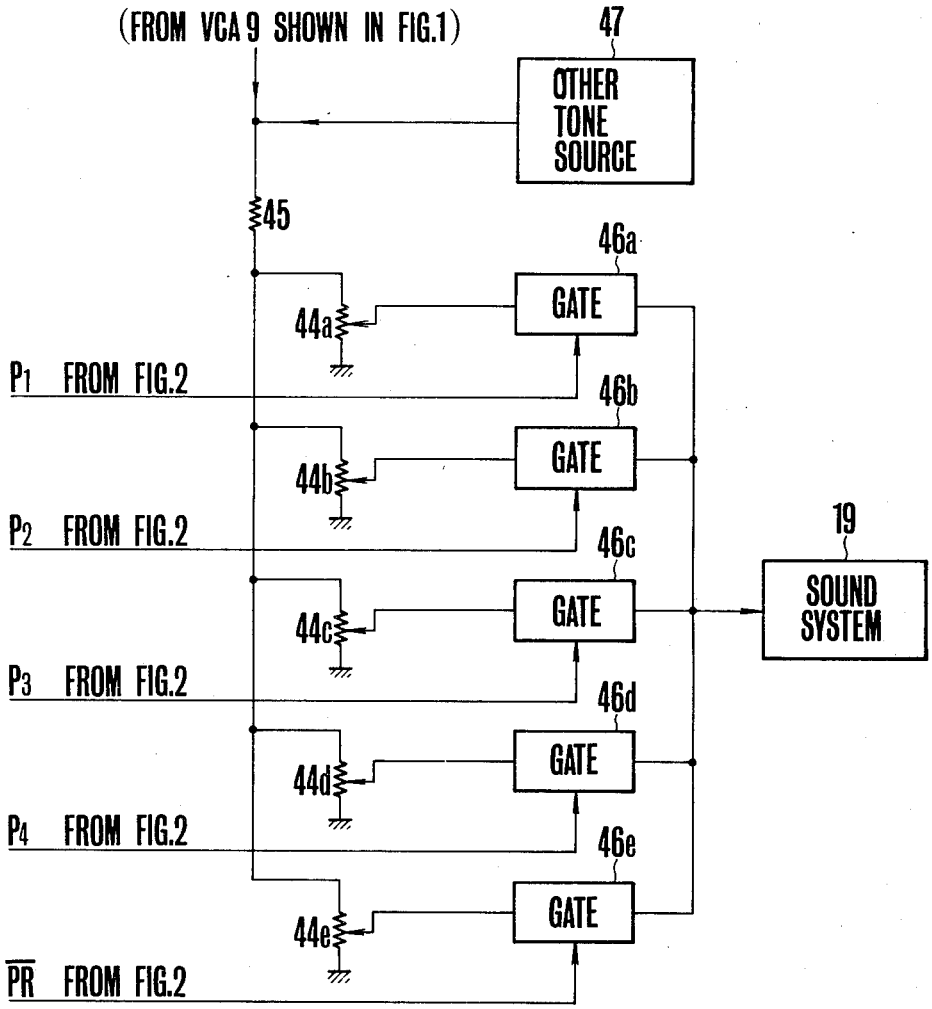

The tone volume preset signal is used to set the volume level of the musical tone signal supplied to the sound system thereby presetting the tone volume level so as to position an expression pedal (not shown) of the sound system to the optimum operating position. Such tone volume preset is done by a circuit shown in FIG. 5. This circuit comprises tone volume preset variable resistors 44*a* through 44*e* connected to respectively receive the output of the voltage controlled amplifier 9 via a resistor 45 and gate circuits 46*a* through 46*e* for applying the preset outputs of the variable resistors 44*a* through 44*e* to the sound system 19. The gate circuit 46*a* through 46*e* are controlled by the preset channel selection signals $P_1$ through $P_4$ and the preset cancel signal $\overline{PR}$. Other tone source 47 such as a tape recorder, an automatic rhythm performance device etc. is also connected to one terminal of resistor 45 so that the output of the other tone source 47 can also be preset.

In the tone volume preset system described above, when the preset tone color selection switch 15*a* is operated to produce a preset channel selection signal $P_1$, only the gate circuit 46*a* is enabled so that the output of the variable resistor 44*a* for presetting the volume of a tone color channel selected by signal $P_1$ is applied to the sound system 19 thereby producing a musical tone having a volume corresponding to the preset value of the variable resistor 44*a*. In the preset cancel state, a preset cancel signal $\overline{PR}$ is supplied to the gate circuit 46*e* so that the tone color of a flute, clarinet, piano and oboe selected by the tone color selection switches 18*a* through 18*d* is generated with a volume corresponding to the preset value of the variable resistor 44*e*.

The circuits shown in FIGS. 2 to 5 show the detail of various preset systems of the preset circuit 14 shown in FIG. 1.

Although in the foregoing description, it was described that the various preset systems were set so as to vary various prestored control signals for the purpose of making the tone color designated by the tone color transfer switches 18*a* through 18*d* to be equal to the standard color it is also possible to make the preset system to be independent of the tone color selecting switch system so as to set a tone color not presenting in the tone color selecting switch system by the preset system.

Figure 6:
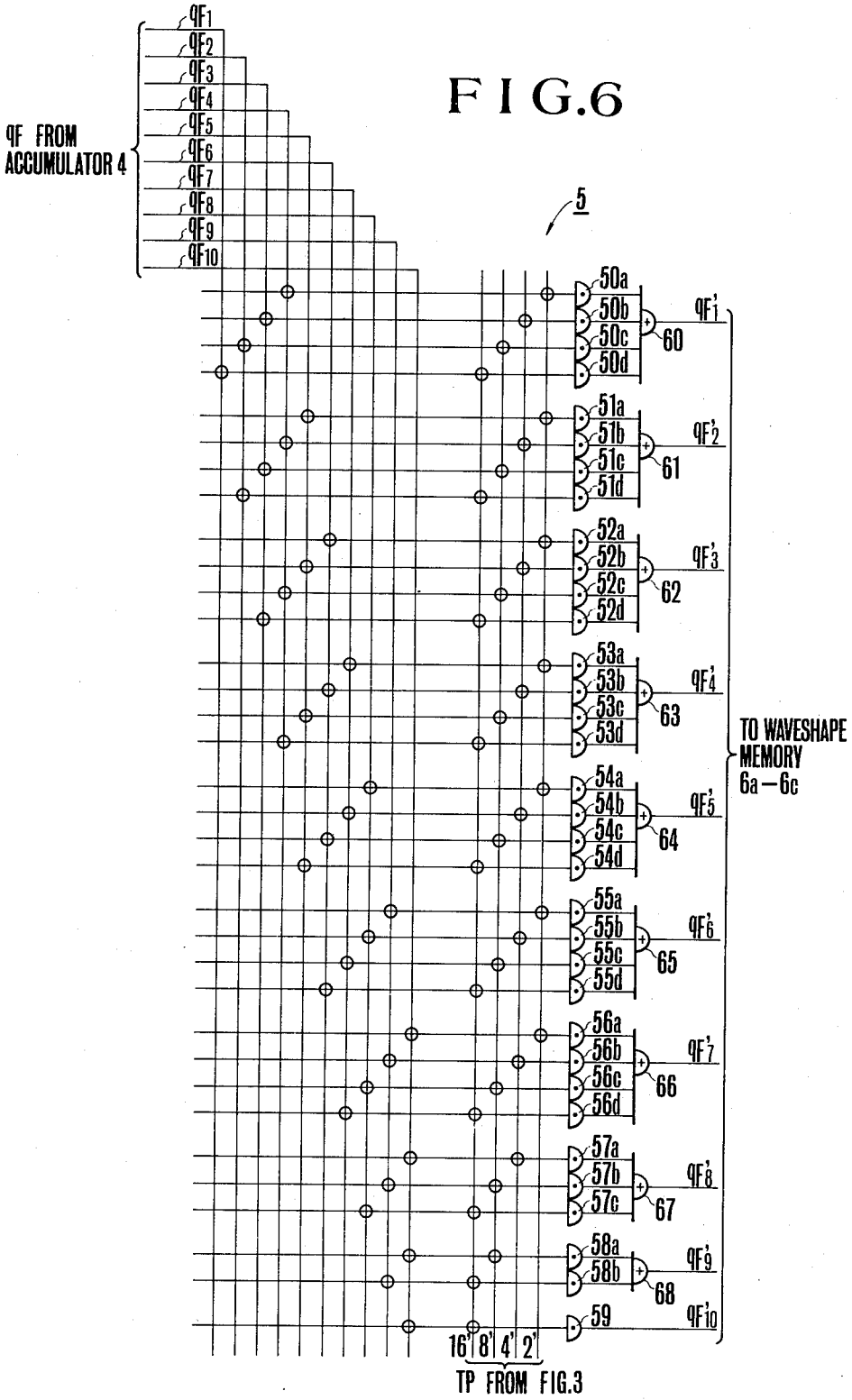
FIG. 6 is a detailed connection diagram showing the shift circuit shown in FIG. 1.
Figure 8:
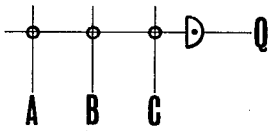
FIG. 8 is a simplified connection diagram for explaining the symbol utilized in the circuits shown in FIGS. 6 and 7.

FIG. 6 shows one example of the shift circuit 5 shown in FIG. 1. Before describing the circuit shown in FIG. 6, a symbol shown in FIG. 8 will firstly be described. This symbol represents an AND gate circuit having one input line crossing a plurality of signal lines, the crosspoints being bounded by small circles. The logical equation of the AND gate circuit shown in FIG. 8 is expressed by $Q=A\cdot B\cdot C$. As shown in FIG. 6, the upper bits of the binary values accumulated by the accumulator are applied to predetermined inputs of AND gate circuits 50*a*–50*d*, 51*a*–51*d* . . . 57*a*–57*d*, 58*a*, 58*b* and 59 via ten output lines in a manner to be described hereunder. The number of the output lines of the accumulator is determined by the capacity of the waveshape memory device which is equal to 1024 in the example illustrated. Assume now that the preset tone color selection switch 15*a* is selected. Then the footage signal TP is sent out through the 4 foot line shown in FIG. 3. As has been pointed out hereinabove, 8 foot register is the normal for the shift circuit 5, so that the footage signal TP from the 4 foot line means a footage change by one octave higher. Under these conditions, AND gate circuits 50*b*, 51*b*, 52*b*, 53*b*, 54*b*, 55*b*, 56*b*, 57*b* and 58*b* are enabled so that the outputs qF, that is $qF_1$ through $qF_9$ are sent to the waveshape memory devices 6*a* through 6*c* via OR gate circuits 60 through 68 to act as the output qF', that is $qF'_1$ through $qF'_9$. When the output from the 8-foot line (this is the normal position not requiring footage change) is applied as the footage signal $TP_1$, AND gate circuits 51*c*, 52*c*, 53*c*, 54*c*, 55*c*, 56*c*, and 57*c* are enabled so that outputs $qF'_1$ through $qF'_8$ are sent out from the OR gate circuits 60 through 67. In the same manner, the output from the 16 foot line supplied as the footage signal TP means a footage change to a position one octave lower. In this case, AND gate circuits 50*d*, 51*d*, 52*d*, 53*d*, 54*d*, 55*d*, 56*d*, 57*d*, 58*d* and 59 are enabled and an output $qF'_1$–$qF'_{10}$ are applied directly to the waveshape memory devices 6*a* through 6*c* from OR gate circuits 60 through 68 and these AND gate circuits. When the output from the 2-foot line is supplied as the footage signal, this means a footage change of two octaves higher. In this case, AND gate circuits 50*a*, 51*a*, 52*a*, 53*a*, 54*a*, 55*a* and 56*a* are enabled so that the outputs $qF'_1$ through $qF'_7$ are applied to the waveshape memory devices 6*a* through 6*c* via OR gate circuits 60 through 66.

Figure 7:
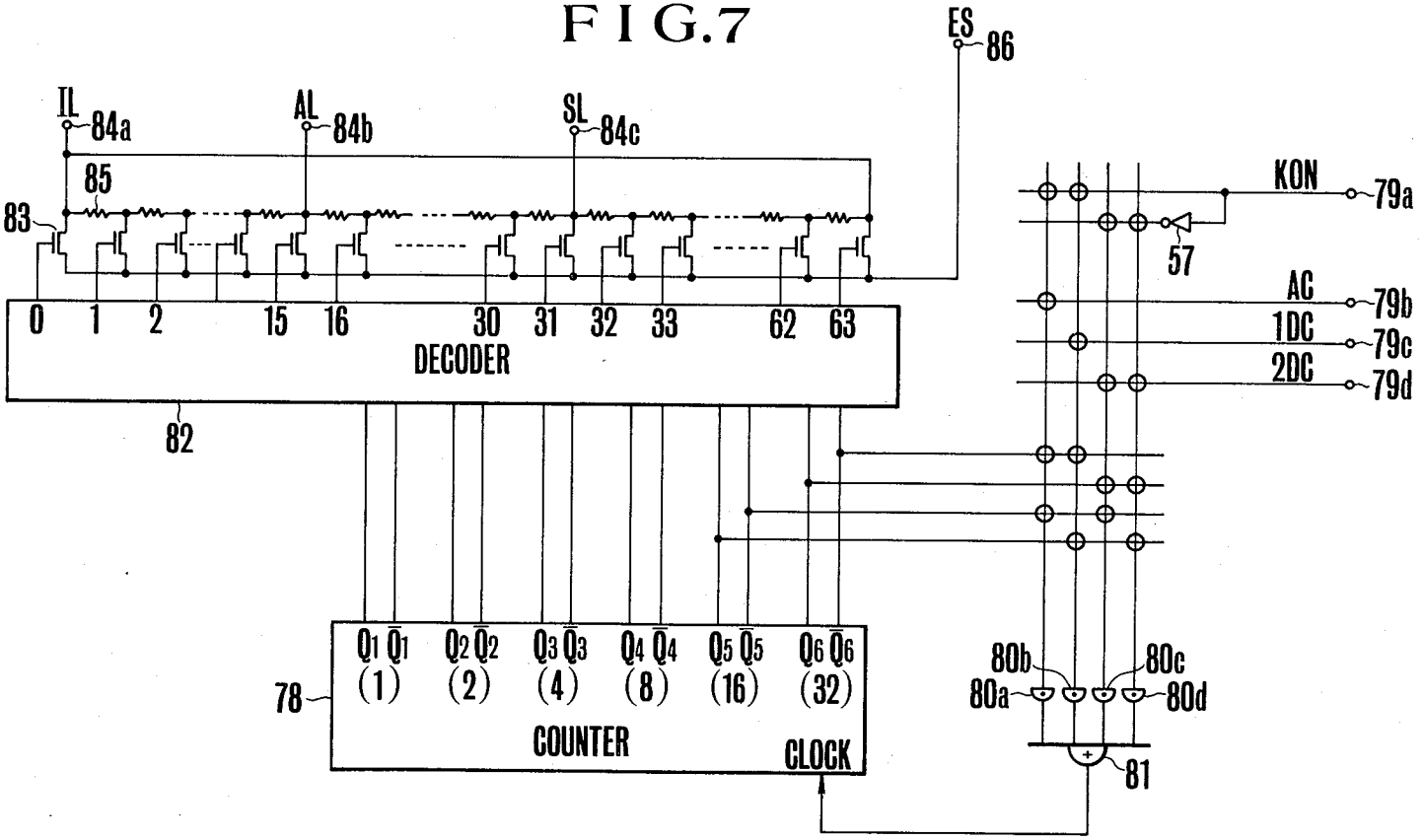
FIG. 7 is a connection diagram showing one example of the envelope generating circuit shown in FIG. 1.

FIG. 7 shows one examples of the first and second envelope generating circuits 12 and 13 shown in FIG. 1. Under a waiting condition, that is before depression of the keys, the binary code outputs $\overline{Q}_1$ through $\overline{Q}_6$ of a 64 digit counter 78 are all "0" and the outputs $\overline{Q}_1$ through $\overline{Q}_6$ are all "1". Under these conditions when a key on signal KON is applied to an input terminal 79*a* from the key switch circuit 1 shown in FIG. 1, since the outputs $Q_5$ and $Q_6$ of the counter 78 are "1", an AND gate circuit 80*a* produces a pulse output each time an attack clock AC is supplied to terminal 79*b* from the oscillator 32*a* or 32*d* shown in FIG. 2. The output of AND gate circuit 80*a* is supplied to the clock terminal of the counter 78 via an OR gate circuit 81 thus causing the counter 78 to sequentially count down. The binary outputs of the counter 78 are converted into individual nomination (i.e. scale of 64) by a decoder 82 and output signals appear on corresponding output terminals. As a consequence, each time the count of the counter 78 is sequentially increased by the attack clock AC, the output terminal which produces an output moves successively from terminal 0 to terminal 63. As the output terminal of the decoder 82 shifts successively in this manner, among a number of transistors connected to respective output terminals, those connected to the output terminals on which outputs appear become conductive. In the example illustrated, terminal 84*a* is supplied with an initial level signal, whereas terminals 84*b* and 84*c* are supplied with an attack level signal AL and a sustain level signal SL respectively from the envelope preset circuit 29 shown in FIG. 2. Voltage dividing resistors 85 are connected between terminals 84*a*, 84*b* and 84*c*, and the transistors 83 are connected to send out voltages at intermediate points of the resistor 85 to an output terminal 86. Consequently, when the counter 78 counts up in response to the attack clock AC, the output terminal on which the output appears moves successively toward the output terminal 63 and the transistors 83 are rendered ON successively. Consequently, the envelope signal ES appearing at the output terminal 86 increases gradually between $t_1$ and $t_2$ shown in FIG. 9. When the count of the counter 78 reaches 15, an output appears on the output terminal 15 of the decoder 82. At this time the output reaches the attack level AL.

When the count of the counter 78 reaches 16 its output terminal $Q_5$ becomes "1" and the output terminal $\overline{Q_6}$ becomes "0" with the result that the AND gate circuit 80*b* applies the first decay clock 1DC generated by the oscillator 32*b* or 32*e* shown in FIG. 2 to the clock input of the counter 78 via the OR gate circuit 81. As a consequence, subsequent to count 16, the counter 78 counts up by utilizing the first decay clock 1DC as the clock pulse so that the decoder 82 shifts the selected transistor 83 toward the terminal SL receiving the sustain level signal. However, since the sustain level SL is set to be lower than the attack level AL, the envelope signal ES sent out from the output terminal 86 decreases gradually with time as shown by $t_2$–$t_3$ in FIG. 9. As the count of the counter 78 reaches 32, the output terminals $Q_6$ and $\overline{Q_6}$ become "1" and "0" respectively so that AND gate circuit 80*b* is disenabled and the counter 78 stops counting in response to the first decay clock 1DC. Then when the key on signal KON becomes "0" due to the release of a key, the output of the inverter 87 becomes "1" whereby AND gate circuit 80*c* sends out the second decay clock 2DC which is generated by the oscillator 32*c* or 32*f* shown in FIG. 2. This second decay clock 2DC is supplied to the clock input of the counter 78 through OR gate circuit 81. Consequently, the counter 78 counts up in response to the second decay clock 2DC and its outputs are decoded by decoder 82, the outputs thereof shifting gradually from output terminal 32 toward output terminal 63. As a consequence, the envelope signal ES sent one from the output terminal 86 decreases gradually from the sustain level SL toward the initial level IL as shown by $t_4$–$t_5$ in FIG. 9.

When the count of the counter 78 reaches 63, both output terminals $Q_5$ and $Q_6$ become "1" so that the AND gate circuit 80*d* is enabled to apply the second decay clock 2DC to the counter via OR gate circuit 81. When the counter 78 receive a single second decay clock 2DC it overflows to return to zero with the result that all AND gate circuits 80*a* through 80*d* are disabled thus terminating the generation of the envelope signal.

While the foregoing description relates to a case in which an envelope signal ES of the continuous mode was produced, an envelope signal of a percussive mode can be obtained by making the sustain level SL applied to the terminal 84*c* to be same as the initial level IL applied to the terminal 84*a*.

Figure 10:
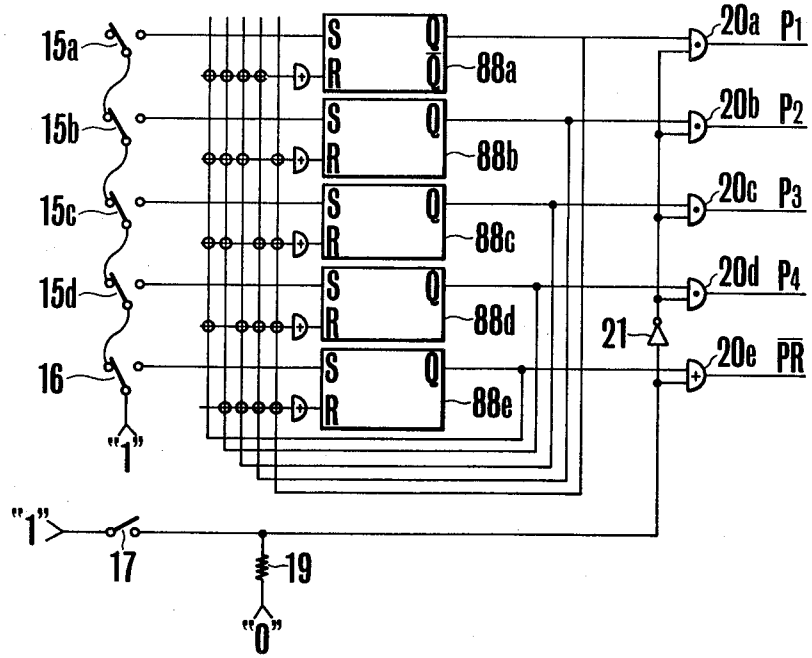
FIG. 10 is a connection diagram showing another example of the preset selector.

Furthermore, in the foregoing embodiment, lock type switches were used as the preset tone color selection switches 15*a* through 15*c* and as the preset cancel switch 16 so that when either one of the switches is operated the other switches are mechanically reset, but the invention is not limited to this arrangement. For example, as shown in FIG. 10, the preset tone color selection switches 15*a* through 15*d* and the preset cancel switch 16 made be constructed as of the nonlock type and the circuit may be constructed such that flip-flop circuits 88*a* through 88*c* are set by the outputs of these switches and that the set outputs of the flip-flop circuits are applied to the reset terminals of, the other flip-flop circuits.

Furthermore, in the above described embodiment the invention was applied to a monophonic electronic musical instrument, the invention is also applicable to a polyphonic electronic musical instrument provided with a plurality of tone generation channels capable of simultaneously producing a plurality of tones.

As above described according to this invention there is provided an electronic musical instrument of the type in which frequency informations read out in response to key data are cumulatively added by an accumulator, and the accumulated and progressing output is used to address a waveshape memory device for producing musical tones, characterized in that a shift circuit is provided between the accumulator and the waveshape memory means, that a plurality of tone color selection signals are preset, and that the preset footage signals are selected by a tone color selection switch and then supplied to the shift circuit so as to effect a footage change in an octave unit. Thus, according to this invention the footage register change can be readily performed with extremely simple construction.

What is claimed is:

1. An electronic musical instrument comprising a key switch circuit providing output signals representative of depressed keys, a frequency information memory device responsive to the key switch circuit output signals which stores frequency information corresponding to depressed keys, a plurality of musical tone forming means including a waveshape memory device for forming musical tones in response to the information stored in said frequency information memory device, a shift circuit interposed between said frequency information memory device and said musical tone forming means for effecting a footage change of an octave unit, a preset circuit for applying a plurality of preset footage change signals to said shift circuit and for applying other preset signal necessary to form said musical tones to said musical tone means, and a manually operable preset selector for simultaneously determining said preset signals necessary to form said musical tones to said musical tone forming means, and a manually operable preset selector for simultaneously determining said preset signals.

2. An electronic musical instrument comprising a key switch circuit providing output signals representative of depressed keys, a frequency information memory device responsive to the key switch circuit output signals for storing frequency corresponding to depressed keys, waveshape memory means responsive to the information stored in said frequency information memory device for producing information necessary to form musical tones, a musical tone forming circuit responsive to the output of said waveshape memory device for forming a desired musical tone, a shift circcuit interposed between said frequency information memory device for effecting a footage change in an octave unit, a plurality of manually operable preset selectors, preset means operated by said preset selectors for presetting a plurality of preset values for determining different informations, and means for applying one of said preset values of the preset selectors simultaneously selected in accordance with a selected preselector to said shift circuit and for applying others of said preset values simultaneously selected to said tone forming means.

3. The electronic musical instrument according to claim 2 wherein said waveshape memory means comprises a plurality of waveshape memory devices, said electronic musical instrument further comprises a plurality of tone color selectors, said preset circuit has preset values for respective informations, said preset values being selectable corresponding to a selected one of said tone color selectors, a plurality of manually operable tone color selectors, and means responsive to a manually selected preset selector and a tone color selector for applying to said shift circuit one of preset values which are selected simultaneously.

4. The electronic musical instrument according to claim 2 wherein each one of the preset selectors comprises a lock type switch and the switches are preferentially connected with each other.

5. The electronic musical instrument according to claim 2 wherein each one of said preset selectors comprises a non-lock type switch and a flip-flop circuit which is set by said switch, and wherein the outputs of respective flip-flop circuits are used as the outputs of said preset selectors and as the reset inputs of the other flip-flop circuits.

6. The electronic musical instrument according to claim 3 wherein said musical tone forming circuit comprises a voltage controlled filter supplied with the outputs of said waveshape memory devices, and means for applying to said voltage controlled filter a preset value selected by said manually operable preset selector and said tone color selector and sent to said shift circuit.

7. The electronic musical instrument according to claim 6 wherein said musical tone forming circuit comprises a tone volume level adjusting circuit, and means for applying to said tone volume level adjusting circuit a preset value regarding tone volume control corresponding to a tone color, said preset value being selected by the operation of said manually operated preset selector and said tone color selector thereby preventing change of the musical tone volume caused by the selection of tone colors.

8. The electronic musical instrument according to claim 7 wherein said preset circuit comprises a plurality of presetters corresponding to respective preset selectors for presetting musical tone volumes and means for applying the output of said musical tone forming circuit to a succeeding stage via said presetters.

9. The electronic musical instrument according to claim 8 wherein said preset circuit comprises a plurality of presetters corresponding to said preset selectors for presetting tone brightness voltages, and means for applying the output of said presetters to said voltage controlled filter for controlling the characteristic thereof.

* * * * *

UNITED STATES PATENT AND TRADEMARK OFFICE

CERTIFICATE OF CORRECTION

PATENT NO. : 4,176,577

DATED : December 4, 1979

INVENTOR(S) : Shigeru Yamada et al.

It is certified that error appears in the above—identified patent and that said Letters Patent is hereby corrected as shown below:

Column 14, Claim 1, line 60, "signal" should read -- signals --.

line 61, after "tone" insert -- forming --.

line 62, after "signal" insert a period -- (.) --.

same line 62, at the end of the line delete "nec-".

lines 63, 64, and 65, beginning with "essary" and ending with "signals." delete in their entirety.

Column 15, Claim 2, line 2, after "frequency" insert -- information --.

Signed and Sealed this

Fourteenth Day of October 1980

[SEAL]

Attest:

SIDNEY A. DIAMOND

Attesting Officer

Commissioner of Patents and Trademarks

UNITED STATES PATENT AND TRADEMARK OFFICE

CERTIFICATE OF CORRECTION

PATENT NO. : 4176577
DATED : December 4, 1979
INVENTOR(S) : Shigeru Yamada, et al.

It is certified that error appears in the above-identified patent and that said Letters Patent are hereby corrected as shown below:

Col. 15 line 9, after "device" insert -- and said waveshape memory device -- ;
line 16, delete "preselector" and insert -- preset selector -- ;

Claim 3, line 21, after "device" insert -- and wherein --;
line 23, delete "said preset circuit has" ;
line 24, delete "preset values for respective informations," ;
line 26, delete "a plurality of manually" ;
line 27, delete "operable tone color selectors".

Claim 6, line 11, change "operable" to -- operated -- ;
Col. 16

Claim 8, line 25, change "circuit" to -- means --;
Col. 16

Claim 9, line 31, change "circuit" to -- means --;
Col. 16

Signed and Sealed this

Seventh Day of June 1983

[SEAL]

Attest:

DONALD J. QUIGG

Attesting Officer

Acting Commissioner of Patents and Trademarks